United States Patent [19]

Walker

[11] Patent Number: 4,557,624

[45] Date of Patent: Dec. 10, 1985

[54] SNOW PLOWABLE PAVEMENT MARKER

[76] Inventor: Floyd E. Walker, 423 Balsam La., Palatine, Ill. 60067

[21] Appl. No.: 530,610

[22] Filed: Sep. 9, 1983

[51] Int. Cl.[4] ..... E01F 9/06

[52] U.S. Cl. ..... 404/14; 404/16

[58] Field of Search ..... 404/15, 16, 9, 14; 116/63 R; 350/107

[56] References Cited

U.S. PATENT DOCUMENTS

| | | | |
|---|---|---|---|
| 2,635,513 | 4/1953 | Batterson | 404/15 |
| 3,332,327 | 7/1967 | Heenan | 404/16 |
| 3,938,903 | 2/1976 | Montgomery | 404/16 |
| 4,127,346 | 11/1978 | Bouffard | 404/15 |
| 4,155,666 | 5/1979 | Flanagan | 404/16 |
| 4,195,945 | 4/1980 | Heenan | 404/16 |
| 4,402,628 | 9/1983 | Grenier et al. | 404/16 |

*Primary Examiner*—Stephen J. Novosad
*Assistant Examiner*—Beverly E. Hjorth
*Attorney, Agent, or Firm*—Hill, Van Santen, Steadman & Simpson

[57] ABSTRACT

A snow plowable pavement marker having a low-profile, including a base member comprising a generally flat circular element having an annular peripheral depending rim adapted to be installed in an annular drilled recess in a highway pavement, the flat lower surface being disposed, in use, directly upon the road surface and the upper surface of the base member providing cavities supporting reflective devices, and the top surface of the base member defining an inclined ramp surface from at least two directions of approach when installed in place in a pavement.

3 Claims, 4 Drawing Figures

SNOW PLOWABLE PAVEMENT MARKER

BACKGROUND OF THE INVENTION

The present invention relates to pavement markers of the type employing cube corner reflex reflectors which are placed on highways for indicating the highway centerline or highway lanes. Pavement markers have become very widely accepted in highway traffic control as means for providing highly visible signals, particularly in combination with conventional painted traffic lines of white or yellow. The pavement markers that have been provided in the past are typically embedded in the surface of the roadway by providing saw cuts in the surface or by providing large diameter drill cuts in various combinations. In practice, accordingly, the cost of installation of prior art reflector devices has been extremely high and has been a significant factor in the success or failure of marketing such devices.

Prior art patents such as U.S. Pat. No. 3,333,327 to Sidney A Heenan provided a prismatic retro reflector of the cube corner type mounted on the surface of the highway by an adhesive. Experience has shown that installation of the reflective device only upon the surface of the roadway has been inadequate in snow areas and, accordingly, markers utilizing various saw cuts, and the like, have been developed. For example, structures such as shown in the later Heenan U.S. Pat. No. 4,195,945 and Flanagan U.S. Pat. No. 4,155,667 have provided relatively complex marker embedding systems. The complexity of the roadway cuts as well as the complexity of the marker base employed therewith, has been excessively costly and, accordingly, disadvantageous for extensive highway use.

SUMMARY OF THE INVENTION

A snow plowable marker is provided which provides a large diameter circular base member intended to sit on the surface of the highway, and which includes a peripheral, annular, flange extending downwardly therefrom, and which is adapted to be embedded in an annular recess drilled in the pavement. The recess in the road is, accordingly, solely an annulus sufficiently deep to accommodate the flange. An air relief aperture is provided through the base member, at the flange or elsewhere, for allowing venting of the area underneath the base during installation on the roadway, and in the ordinary installation mode, an epoxy or other generally weather-proof adhesive, is applied to the annular cut in the road and the surface of the roadway within the area of the annulus. The marker base is then pressed into the annular cut with the flange of the base being cemented in the annular cut and with the bottom surface of the marker adhesively affixed to the roadway surface.

The top of the marker base of the present invention is very gradually inclined and is provided with generally rectangular recesses adjacent its central area into which bi-directional reflecting elements of the conventional, commercially available, cube corner reflex reflector type are positioned. The present invention does not include the specific form of such reflector elements which may comprise any of the known reflector elements capable of returning light from automotive headlights back to the operator thereof. It is contemplated that in the ordinary utilization, bi-directional reflector elements will be incorporated so that a marker constructed in accordance with the present invention would be used as a lane indicator along the middle strip of a highway. In such circumstances, the reflector would be visible by vehicle operators traveling in either direction on the highway. It is of course contemplated that single direction reflectors may be employed where desired without departing from the concepts of the present invention.

It is an important feature of the present invention to provide a snow plowable pavement marker which is installed in an extremely simple and inexpensive manner in the roadway but which has an extremely high combinational integrity with the roadway under impact conditions caused by vehicle wheels and roadway maintenance machines such as snow plows or the like.

DESCRIPTION OF THE PREFERRED EMBODIMENT

Figure 1:
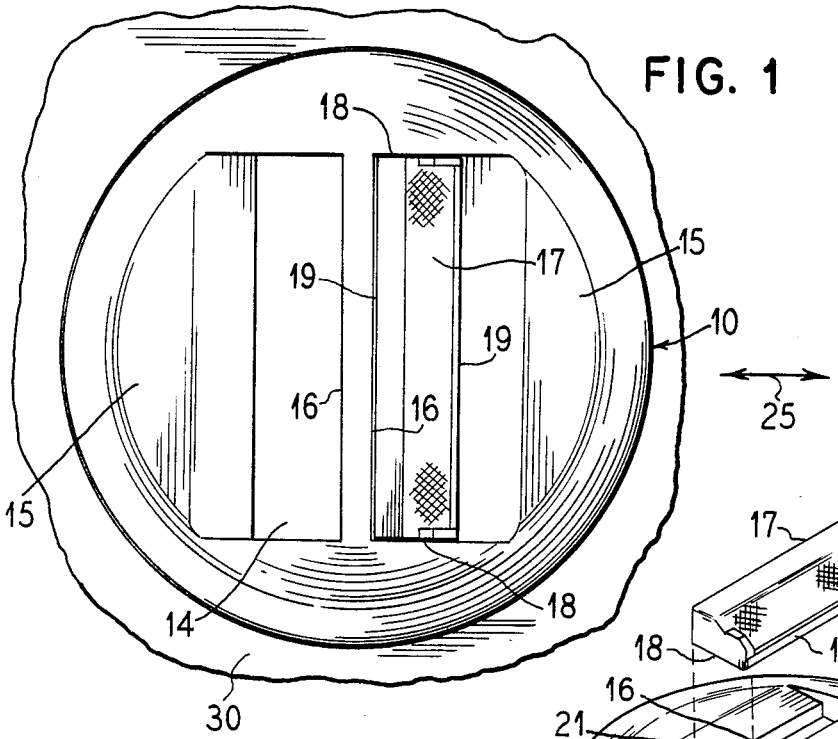
FIG. 1 is a top plan view of a pavement marker constructed in accordance with the present invention.

Referring to the figures of the drawings, a bi-directional snow-plowable pavement marker is generally designated by the numeral 10 and comprises a base 11 having an annular depending flange 12 and a flat under surface 13. The upper surface of the base 11 is provided with a pair of oppositely facing generally rectangular cut out recesses 14, each having a flat approach surface 15 and a central upstanding support wall 16. As shown in FIG. 1, one of the recesses 14 is provided with a reflector 17 which has a generally rectangular bottom surface defined by the end walls 18 and sidewalls 19 is sized to snugly fit the recess formed by the sidewalls 16, end walls 20 and an entry wall 21. The reflector elements 17 may be cemented into one or both of the recesses 14 to provide a uni-directional or bi-directional roadway marker.

Figure 2:
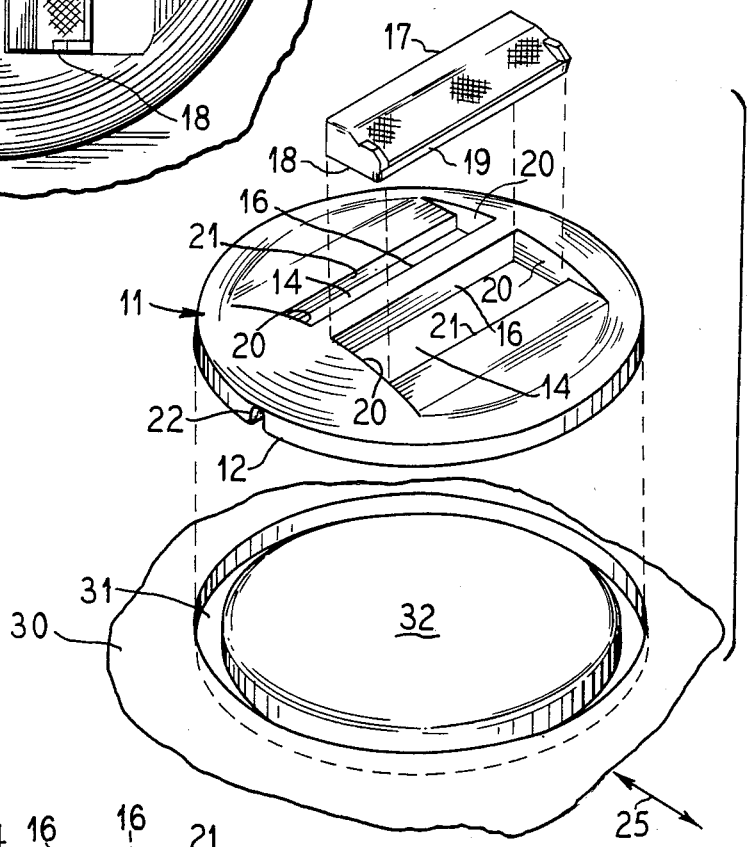
FIG. 2 is a generally isometric view, exploded, of a pavement marker constructed in accordance with the present invention, and the roadway surface modified for its attachment.

The marker is inserted in the roadway with a traffic directional flow being indicated by the arrow 25 in FIGS. 1 and 2. As clearly shown in FIGS. 2 and 3, the roadway 30 is provided with an annular cut 31 which snugly accommodates the flange 12 of the marker base 11. The surface 32 of the roadway within the annulus 31 is at the same upper level as the roadway 30 generally, so that the only material removed from the road is the annular portion 31. In installation, adhesive 33 is placed upon the portion 32 and in the annulus 31, and the marker is pressed downwardly providing a complete adhesive contact between the bottom surface 13 of the marker and road surface 32 and between the flange 12 and the annular cut 31. In the installation process air is vented from underneath the marker by way of a channel 22 in the flange 12. This vent, may, of course, be provided by an aperture drilled through the marker base from bottom surface 13 through to the top surface.

Figure 3:
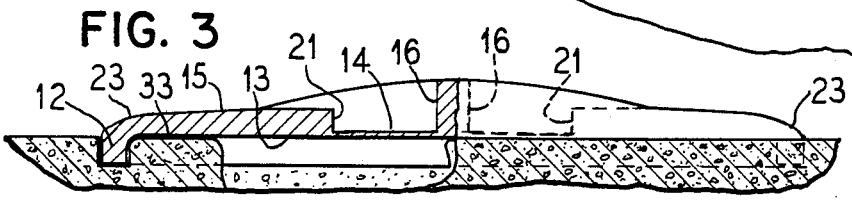
FIG. 3 is a side-elevational view of the pavement marker shown in FIG. 1, partially in cross-section.
Figure 4:
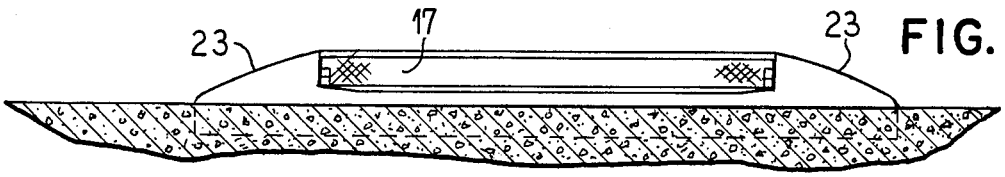
FIG. 4 is an end-elevational view of the pavement marker shown in FIG. 1 in position in the roadway.

As may be seen from a consideration of FIGS. 3 and 4, the roadway marker of the present invention has a very slight incline at its outer peripheral edge, as indicated at 23 to permit a snow plower blade or like instrument to readily ride over the marker without prying it from the pavement or destroying the reflectors embedded therein.

While variations may be made in the construction of the marker as above described, it is my intention that the scope of the invention be limited solely by that of the hereinafter appended claims.

I claim:

1. A reflector for surface mounting on a roadway comprising a circular plate with a generally flat undersurface with a peripheral annular flange depending therefrom for insertion in and adhesive attachment to an annular trough in the road surface, said flat undersurface extending to said flange throughout its periphery whereby substantially the entire flat surface rests upon and is adhesively attached to the road surface, a generally annular sloping upper surface on said plate providing a centrally positioned rounded mound surface, a reflector cavity formed in said mound and comprising a generally straight side wall adjacent the diameter and end walls perpendicular thereto, the bottom of said cavity being adjacent said undersurface, and reflector means secured in said cavity with the upper surface thereof located below the top of said straight side wall, and the lower surface located adjacent the road surface.

2. The reflector of claim 1 wherein a pair of cavities are formed on opposite sides of said side wall and wherein oppositely facing reflector means are secured in said cavities.

3. The reflector of claim 1 wherein the reflector is secured in said cavity by adhesive.

* * * * *